US006005222A

United States Patent [19]

Hicks

[11] Patent Number: 6,005,222

[45] Date of Patent: Dec. 21, 1999

[54] COLD WEATHER GARMENT

[76] Inventor: Stewart Hicks, 3318 24th St., Lubbock, Tex. 79410

[21] Appl. No.: 09/156,001

[22] Filed: Sep. 17, 1998

[51] Int. Cl.[6] ..... H05B 1/00

[52] U.S. Cl. ..... 219/211; 2/79

[58] Field of Search ..... 2/79, 82, 93, 108, 2/115; 428/109, 131, 137; 219/212–217, 549, 211

[56] References Cited

U.S. PATENT DOCUMENTS 4,539,714 9/1985 Fratti ..... 2/108

4,569,874 2/1986 Kuznetz ..... 428/109

4,722,099 2/1988 Kratz ..... 2/79

*Primary Examiner*—Tu Ba Hoang

[57] ABSTRACT

A cold weather garment which, through power produced by solar panels embedded in the exterior of the garment, which, in turn, operate heating elements, the heat from which are directed toward the interior of the garment, actively augments the wearer's natural heat production. Because the garment's heating facilities are powered by solar cells, all hazards from flammable fuels are eliminated, there are no expensive batteries to repeatedly replace, and, so long as sun light is available, the wearer will be warmed indefinitely.

2 Claims, 1 Drawing Sheet

COLD WEATHER GARMENT

BACKGROUND OF THE INVENTION

1. Field of The Invention

Applicant's invention relates to winter weather garments.

2. Background Information

Maintaining warmth in frigid environments can range from a matter of comfort to one of survival, depending on the circumstances.

Despite the improvements in winter weather garments over recent times, presently available such garments all have one characteristic in common—unless some heating accessory is introduced by the wearer, any warmth experienced by the wearer is generated by the wearer's own body. For somewhat cold environments, and in fairly calm wind situations, "passive warming" may suffice. However, in extremely cold conditions, on ones in which wind renders the temperature at an effective much lower level than actual thermometer readings, some form of heat augmentation is desirable.

For years, lighter fluid-fueled "hand warmers" have been available as an auxiliary source of heat for persons who venture outdoors in cold conditions. Also, certain chemically actuated heating packets are available for emergency situations. Further still, battery operated socks and gloves are available. However, the use of lighter fluid-based hand warmers poses obvious safety hazards, for they involve, quite literally, introducing a smoldering canister of flammable liquid into one's garment. Furthermore, chemical heat packs are expensive, and last for limited durations, and battery powered, heated garments, such as socks and gloves, have very short service life between battery changes.

So far as the present inventor is aware, there is no winter weather garment available which: (1) actively provides warmth to its wearers; (2) does not involve the use of fuels or expendable power sources; and (3) has virtually unlimited service life.

It would be quite beneficial to persons who frequent frigid environments to have available a garment which exhibits each of the foregoing characteristics which are lacking in presently available cold weather garments.

SUMMARY OF THE INVENTION

It is an object of the present invention to provide a novel cold weather garment which more effectively maintains the wearer in relative warmth than presently available cold weather garments.

It is an object of the present invention to provide a novel cold weather garment which actively introduces heat into its enclosure to warm its wearer;

It is an object of the present invention to provide a novel cold weather garment which, while it produces heat to augment the wearer's own body heat, does not involve the use of flammable fuels or expendable power sources.

It is an object of the present invention to provide a novel cold weather garment which, while it produces heat to augment the wearer's own body heat, and does not involve the use of flammable fuels or expendable power sources, has virtually unlimited service life.

In satisfaction of these and related objectives, Applicant's present invention provides a cold weather garment which, through power produced by solar panels embedded in the exterior of the garment, which, in turn, operate heating elements, the heat from which are directed toward the interior of the garment, actively augments the wearer's natural heat production. Because the garment's heating facilities are powered by solar cells, all hazards from flammable fuels are eliminated, there are no expensive batteries to repeatedly replace, and, so long as sun light is available, the wearer will be warmed indefinitely.

Garments made according to the present invention will be of great benefit to hikers, skiers, and outdoor winter sportsmen.

DETAILED DESCRIPTION OF THE PREFERRED EMBODIMENT

Figure 1:
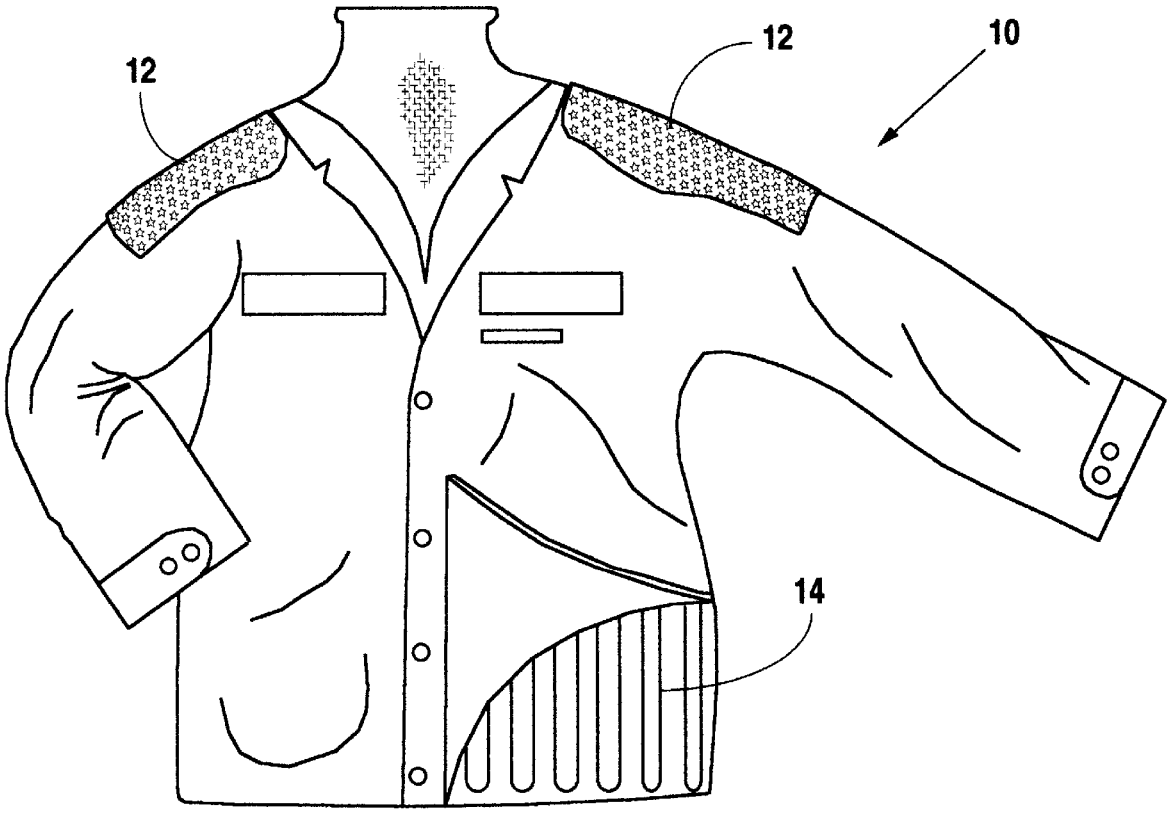
FIG. 1 is front elevational view of a winter weather garment of the present invention, with representations (not necessarily to scale or reflecting specific desired appearance) of solar power panels and heating elements.

Referring to FIG. 1, a winter weather garment of the present invention is identified generally by the reference numeral 10.

Exposed to the exterior shell surface of garment 10 are solar power panels 12. Solar power panels 12 are, in any preferred embodiment, shaped such that they appear to be decorative, fabric insets for the garment. Garment 10 is depicted here having two ovoid solar power panels 12, but any array of panels 12 is acceptable, provided that, when exposed to at least moderate levels of sun light, they collectively produce sufficient power for their intended purposes. In other words, if the collective surface area of the solar power panels 12 is sufficient to produce the required power for intended present purposes, all the better that they be shaped as stars, circles, moons, or any other shape which would aesthetically enhance the garment 10.

Positioned interiorly of the garment 10 are electric heating elements 14, shown schematically in FIG. 1. In the preferred embodiment of the present invention, heating elements 14 are arranged near the bottom margin of the garment 10 in recognition of the fact that the heat generated by the heating elements 14 will rise within the garment 10. Also, in certain embodiments of garment 10, additional heating elements will be present in the sleeves and/or (as applicable to garments which include pant portions) in the leg portions of garment 10.

The heating elements 14 used in the present invention may be similar, if not identical, to those used in battery powered socks or gloves, for they are already proven with respect to relatively low power consumption, flexibility, and safety. Certainly, the power requirements for heating elements 14, and the corresponding requirements for the collective voltage and amperage output of solar power panels 12 chosen for this application are well within the skills of persons practicing in these fields and need not be specified here.

On alternative embodiment of the present garment 10 may include rechargeable batteries (not shown in the drawing) which charge so long as the solar power panels are producing power in excess of that accepted by the heating elements 14. Such an embodiment would provide heat of a less cyclical nature, and would extend the useful life of the garment past a time of light exposure sufficient to power the heating elements 14.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A cold weather garment comprising:

a garment body constructed to clothe a portion of the human body, said garment body having an exterior garment surface and an interior garment surface, said interior garment surface defining an enclosure in which said portion of said human body may reside;

a solar power cell, said solar power sell being affixed to said garment body, and having a solar collecting surface facing outward from said exterior garment surface for collecting incident solar rays and generating an electrical current in response thereto;

heating element means positioned interiorly of said garment body for, when operative, emanating heat from a portion of said interior garment surface for heating said enclosure of said garment; and electrical connection means for establishing operative electrical circuitry between said solar power cell and said heating element means, whereby, when said solar power cell produces said electrical current in response to said incident solar rays, said heating element means generates heat for introduction into said enclosure and warming a wearer of said garment.

2. The garment of claim 1 further comprising:

electrical storage means integrated in said circuitry between said solar power cell and said heating element means for collecting power from said solar power cell and dispensing power to said heating element means.

* * * * *